US007534755B2

(12) United States Patent
Boutique et al.

(10) Patent No.: US 7,534,755 B2
(45) Date of Patent: May 19, 2009

(54) LIQUID DETERGENT COMPOSITIONS WITH VISIBLY DISTINCT BEADS

(75) Inventors: Jean-Pol Boutique, Gembloux (BE); Frederik Vandenberghe, Gentbrugge (BE); Johan Smets, Lubbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/799,918

(22) Filed: May 3, 2007

(65) Prior Publication Data

US 2007/0259800 A1 Nov. 8, 2007

(30) Foreign Application Priority Data

May 3, 2006 (EP) ..... 06113458

(51) Int. Cl.
*C11D 3/37* (2006.01)

(52) U.S. Cl. ..... 510/276; 510/296; 510/462; 510/349; 510/416; 510/418; 510/419; 510/475; 510/214; 510/309; 510/311; 510/286; 510/287

(58) Field of Classification Search ..... 510/276, 510/296, 462, 349, 416, 418, 419, 475, 214
See application file for complete search history.

(56) References Cited

U.S. PATENT DOCUMENTS

| | | | | |
|---|---|---|---|---|
| 3,597,304 | A | 8/1971 | Baldwin et al. | |
| 5,972,049 | A | 10/1999 | Wicker et al. | |
| 6,579,842 | B2 | 6/2003 | Howell et al. | |
| 6,586,384 | B2 | 7/2003 | Hemmington et al. | |
| 7,169,741 | B2 * | 1/2007 | Barry et al. | 510/337 |
| 2005/0043200 | A1 * | 2/2005 | Barry et al. | 510/421 |
| 2006/0019860 | A1 * | 1/2006 | Cardozo et al. | 510/454 |
| 2006/0040844 | A1 * | 2/2006 | Boutique et al. | 510/445 |
| 2006/0111264 | A1 * | 5/2006 | Smets et al. | 510/475 |

FOREIGN PATENT DOCUMENTS

| | | | |
|---|---|---|---|
| DE | 198 21 695 | A1 | 11/1999 |
| GB | 2 343 456 | A | 5/2000 |
| WO | WO 95/30042 | | 11/1995 |
| WO | WO 98/00500 | | 1/1998 |
| WO | WO 98/29528 | | 7/1998 |
| WO | WO 99/00477 | | 1/1999 |
| WO | WO 9900477 | A1 * | 1/1999 |
| WO | WO 99/14245 | | 3/1999 |
| WO | WO 00/18862 | | 4/2000 |
| WO | WO 2006/055787 | A1 | 5/2006 |

OTHER PUBLICATIONS

International Search Report, mailed Oct. 29, 2007, 3 pages.

* cited by examiner

*Primary Examiner*—Mark Eashoo
*Assistant Examiner*—Jane L Stanley
(74) *Attorney, Agent, or Firm*—Armina E. Matthews; Kim William Zerby

(57) ABSTRACT

A liquid detergent composition comprising a liquid matrix having dispersed therein a plurality of visibly distinct beads and wherein the visibly distinct beads comprise a hueing agent.

11 Claims, No Drawings

LIQUID DETERGENT COMPOSITIONS WITH VISIBLY DISTINCT BEADS

TECHNICAL FIELD

The present invention is in the field of liquid detergents, in particular it relates to a liquid detergent comprising a hueing agent.

BACKGROUND OF THE INVENTION

When washing or cleaning articles, such as garments, consumers prefer that such articles maintain their colour, even after repeated cleaning cycles. This is especially true with white materials, as their colour is closely associated with cleanliness. However, the perception of colour, and in particular whiteness, varies between consumers. The variations in perception are believed to be the result of a number of cultural and social factors, including the cultural colour associations of the observer. For example, Egyptian and Mexican consumers typically perceive a blue hue as white, while Indian consumers typically perceive a violet-pinkish hue as white.

While some dyes, when used in a cleaning or treatment composition, may improve the whiteness perception of a material, they can build-up or deposit unevenly on the material, which may lead to discoloration and spotting. In such cases the whiteness perception may in fact be decreased or, at worst, spotting may be seen. This is particularly the case when higher concentrations of such dyes are used under stressed conditions, such as long soak times and/or cold water conditions. While several techniques have been used to increase the efficiency of deposition on materials (See for example WO 2000/18862, WO 99/14245, WO 98/29528, WO 98/00500, WO 95/30042, U.S. Pat. Nos. 6,579,842, 6,586,384, 5,972,049, and 3,597,304) there remains a need for cleaning and/or treatment compositions that can provide tailored colour perceptions, such as whiteness or blackness without dye build-up or spotting.

Another problem associated with the use of such dyes in heavy duty liquids is that the dye will dominate the colour of the liquid detergent itself, limiting the range of colours achievable for detergents comprising the dye. Consumers will often choose a product depending on its colour and so there is a need to be able to provide detergents of different colours, but which also comprise a dye which imparts the correct tailored colour perception for that particular consumer group.

The present invention seeks to provide an improved liquid detergent composition for providing tailored colour perception.

SUMMARY OF INVENTION

The present invention encompasses a liquid detergent comprising a liquid matrix and visibly distinct beads. The composition comprises a hueing agent. The hueing agent can be present in the liquid matrix, beads or in both. According to a first aspect of the present invention there is provided a liquid detergent composition comprising a liquid matrix, preferably an aqueous liquid matrix, having dispersed therein a plurality of visibly distinct beads, wherein the visibly distinct beads comprise a hueing agent. By having the hueing agent present in the beads, the colour of the hueing agent will not dominate the colour of the liquid matrix. Therefore, it is possible to present the liquid detergent in a variety of colours, while still providing a hueing effect. Furthermore, it has been found that by having the huing agent present in the beads, rather than solely in the liquid matrix, it is possible to reduce the risk of spotting or discoloration.

In a further embodiment of the present invention the hueing agent is present both in the beads and in the liquid matrix. It has been found that by having the hueing agent located both in the beads and in the liquid matrix, much higher overall levels of hueing agent may be achieved with a reduced risk of spotting, even under stressed conditions, such as cold water or prolonged-soak washes. This is accomplished while still being able to achieve different colours of detergent from that of the hueing agent. Preferably, when expressed as weight % of the hueing agent in the liquid detergent composition, the beads comprise from about 0.000001% to about 0.25%, preferably about 0.0001% to about 0.1%, even more preferably from about 0.001% to about 0.015% of hueing agent. Preferably, when the hueing agent is present in the liquid matrix, the liquid matrix will comprise from about 0.00001% to about 0.25%, preferably about 0.0001% to about 0.1%, even more preferably from about 0.001% to about 0.015% by weight of the liquid detergent composition of hueing agent. Preferably the ratio by weight of hueing agent in the beads to that in the liquid matrix is from about 5:1 to about 1:5, more preferably about 3:1 to about 1:3, even more preferably from about 2:1 to about 1:2, and most preferably about 1:1. These concentrations and ratios have been found to be particularly effective at achieving levels of hueing agent which would otherwise lead to spotting if present in a liquid matrix alone.

In a further embodiment of the present invention the hueing agent is a dye-conjugate. Preferably the dye conjugates for use in the present invention may be selected from the group consisting of dye-polymer conjugates, dye-clay conjugates and combinations thereof. Dye conjugates are particularly preferred as they can be made suitable for different materials and fabrics, tailored to provide hueing agents of different colours, and can be stripped from materials so as to prevent unwanted build-up and discolouration. A dye conjugate which comprises modified carboxymethylcellulose with remazol brilliant blue dye grafted thereon is particularly preferred.

In a further embodiment of the present invention the liquid detergent may further comprise a stripping agent. The stripping agent is a composition which is employed to remove excess or unwanted dye conjugate, preventing dye build-up and reducing further the risk of spotting or discoloration. An additional benefit resides in the fact that it is believed that dirt and soil adhere to dye conjugate coatings, rather than to the material so coated, thus when such a coating is stripped, dirt as well as residual dye is removed.

Preferably the liquid detergent will comprise at least about 0.0001% by weight of the composition, preferably from about 0.0001% to about 10% by weight of the composition, more preferably from about 0.0001% to about 2% by weight of the composition or even more preferably from about 0.001% to about 0.1% by weight of the composition of a stripping agent. Preferably, the stripping agent may be selected from the group consisting of enzymes, zwitterionic polymers, non-ionic surfactants, transition metal catalysts, per-acid/organic catalysts, alternative singlet oxygen generators, and mixtures thereof.

In a further embodiment of the present invention, either the beads or the liquid matrix or combinations thereof may comprise the stripping agent. Preferably, when the dye conjugate is present only in the beads, the stripping agent is present only in the liquid matrix. If the porosity of the beads is suitable this will have the added advantage of preventing the dye conjugate from coming into contact the stripping agent prematurely. For instance, an enzymatic stripping agent such as glucanase may be prevented from prematurely coming into contact with and cleaving the bond between a dye and its corresponding substrate. This will vastly improve the overall performance and shelf-life of the system.

In a preferred embodiment of the present invention the liquid detergent comprises from about 0.01% to about 10% by weight of the composition, preferably about 0.05% to about 5% by weight of the composition, even more preferably from about 0.01% to about 3% by weight of the composition and most preferably from about 0.2% to about 1% by weight of the composition of the visibly distinct beads. This concentration of beads has been found to be particularly advantageous both in terms of the visual appearance of the liquid detergent and the delivery of the hueing agent without undesirable side-effects. In another preferred embodiment of the present invention the visibly distinct beads have a mean diameter (or effective diameter which is the diameter of a sphere of the same mass as a non-spherical bead) of from about 0.2 mm to about 8 mm, preferably about 0.5 mm to about 3 mm and more preferably from about 1 mm to about 2 mm. These ranges are preferred as they are visible and those most appropriate for manufacturing and suspension in the liquid matrix.

In a further preferred embodiment of the present invention the visibly distinct beads are polyelectrolyte complex microcapsules. Preferably the beads will comprise a core comprising an anionic polyelectrolyte and a semi-permeable membrane comprising a complex formed between a cationic polyelectrolyte and the anionic polyelectrolyte of the core. Preferably, the polyelectrolytes will be alginate and chitosan. These are particularly preferred not only because of there ease of manufacture, but also because upon rupturing in the wash liquor they do not leave any residue on the materials or fabrics being cleaned or the cleaning apparatus.

In a preferred embodiment of the present invention the liquid matrix is essentially free from colorants. Preferably, the liquid matrix is translucent. It is particularly preferred if reverse side printed labels are clearly discernable through the liquid matrix. This is of particular benefit as it enables the use of reverse-side printed labels on clear bottles, which are otherwise difficult, if not impossible, to perceive when a hueing agent is present in a liquid detergent. In another preferred embodiment of the present invention the liquid matrix will comprise a colorant of different colour to the hueing agent. This has the advantage of enabling a greater diversity of coloured liquid detergents for consumers, while still being able to tailor the hueing effect to that particular group of consumers. This is difficult to achieve otherwise as the hueing agent will often dominate the colour of the liquid detergent, and thereby limit the number of colours achievable.

In a further preferred embodiment of the present invention the liquid matrix further comprises a second plurality of visibly distinct beads which are essentially free from the hueing agent. Preferably, the second beads which are essentially free from the hueing agent will be of a different colour to the beads comprising the hueing agent. Preferably, the second beads will comprise a dye of different colour to the hueing agent. Preferably, the beads which are essentially free from the hueing agent will provide a cleaning benefit not provided by the beads comprising the hueing agent containing beads. The advantage of this is that it provides further aesthetic appeal, and also enables delivery of different cleaning functions in a manner which is communicated clearly to the consumer.

In another preferred embodiment of the present invention the visibly distinct beads further comprise a permeability regulator. Preferably, the visibly distinct beads comprise both the hueing agent and the permeability regulator. The permeability regulator will typically plug pores in the semi-permeable membrane; thereby, reducing its permeability. Preferably, the permeability regulator comprises a plurality of micro-particles or nano-particles with a particle size of from about 1 nm to about 10,000 nm, preferably from about 10 nm to about 5,000 nm and more preferably from about 100 nm to about 400 nm. Typically, the particle size corresponds to the volume average hydrodynamic volume, this being the volume of the particle plus its hydration sphere. Typically, it can be calculated using dynamic light scattering with a Brookhaven Zeta Plus Analyser. The light scattering is measured at an angle of 90°, at 25° C. over 5 minutes. Preferably, the permeability regulator is selected from the group consisting of silicas, water-insoluble clays, latexes, or other suitable nano-particles. Preferably, the permeability regulators are styrene/acrylic nano-particles. Suitable examples include Acusol OP 301 and Mirapol CP1. Preferably, the permeability regulators are added to the liquid core material prior to the fabrication of the beads. The use of permeability regulators reduces the leakage of the hueing agent from the beads and also reduces the uptake of any incompatible material which can enter the beads from the liquid matrix.

DETAILED DESCRIPTION OF THE INVENTION

The present invention envisages a liquid detergent composition comprising a liquid matrix having dispersed therein a plurality of visibly distinct beads and wherein the visibly distinct beads comprise a hueing agent. The liquid detergents provide outstanding tailored colour perception, while allowing greater freedom for colouring the detergent.

Hueing Agent

Hueing agent is understood to encompass any non-fluorescent dye or colorant, which is used as part of a cleaning composition to impart a colour upon an article so as to change the perception of one or more of the colours, shades, whiteness or blackness of the article so cleaned. Preferably, the hueing agent will bind to the surface of the material. Preferably, the hueing agent will improve the perception of whiteness or blackness; whiteness is most preferred.

The hueing agent of the present invention may be a dye-conjugate. Dye conjugates include materials wherein a dye and a conjugating material, for example a polymer or clay, are chemically and/or physically bound together. Such dye conjugates may be chosen based on a number of characteristics including, the dye and/or dye conjugate's charge, the dye's light fastness and/or sensitivity to stripping agents, polymer molecular weight and the other detergent ingredients. The conjugate enables the dye to bind to the material so treated. In certain embodiments of the invention, the dye conjugate may be chosen or at a concentration such that an optional stripping agent is not required. Suitable dye to conjugate weight ratios include from about 5:1 to about 1:10 or even from about 5:1 to about 1:1000.

Suitable dye conjugates may be obtained from Megazyme International Ireland Ltd. Bray Business Park, Bray, Co. Wicklow, Ireland (for example, Azo-CM-Cellulose) or the teachings of the following documents: Dyes & Paints: A Hands-On Guide to Colouring Fabric by Elin Noble, Publisher: Martingale and Company; (Mar. 1, 1998) ASIN: 1564771032 pages 33 through 45 and/or The Basic Guide to Dyeing & Painting Fabric by Cindy Walter and Jennifer Priestley Publisher: Krause Publications; Bk & Access edition (Mar. 1, 2002) ISBN: 0873493346 pages 16 and 20 through 34.

Suitable dyes may be obtained from Askash Chemicals & Dyestuffs Inc. 561 Mitchell Road, Glendale Heights, Ill.

60139 USA; DyStar GmbH & Co. Deutschland KG Industriepark Hoechst, 65926 Frankfurt, Germany; Classic Dyestuff Inc. PO Box 2368, High Point, N.C. 27261 USA; BASF Aktiengesellschaft, Global Business Management Performance Chemicals for Textiles, EVT, 67056 Ludwigshafen, Germany. Suitable polymeric materials may be obtained from Noviant Delta 1P, Business Park Ijsseloord, 2 P.O. Box 2016, NL-6802 CA Arnhem, Netherlands; National Starch and Chemical, 10 Finderne Avenue Bridewater, N.J. 08807-3300 U.S.A; Croda Colloids Ltd, Foundry Lane Ditton Widnes Cheshire WA8 8UB England; Hercules Incorporated, 1313 North Market Street, Wilmington, Del. 198-0001 USA; Suitable smectite clays may be obtained from Colin Stuart Minchem, Weaver Valley Road, Winsford Cheshire CW7 3BU, England (e.g. Quest Bentonite); Laviosa Chimica Via Leonardo da Vinci 21, 57123 Livorno, Italy (e.g. Detercals); Sued Chemie Ostenriederstrasse 15, 85368 Moosburg, Germany (e.g. Laundrosil); Southern Clay Products, 1212 Church Street, Gonzale, Tex. 78629 USA (e.g. Gelwhite and Laponite clays); Elementis Specialties, 329 Wyckoofs Mill Road, 329 Hightstown, N.J. 08520 USA (e.g. Bentone EW).

Preferably the dye conjugates for use in the present invention may be selected from the group consisting of dye-polymer conjugates, dye-clay conjugates and combinations thereof. Preferably, said dye conjugate may be selected from the group consisting of: (1) dye polymer conjugates comprising at least one reactive dye and a polymer comprising a moiety selected from the group consisting of a hydroxyl moiety, a primary amine moiety, a secondary amine moiety, a thiol moiety and combinations thereof; and (2) dye clay conjugates comprising at least one cationic/basic dye and a smectite clay.

Preferably the dye-polymer conjugate may be selected from the group consisting of: (1) dye polymer conjugates comprising at least one reactive dye selected from the group consisting of reactive dyes CI Reactive Yellow 1 through 213, CI Reactive Orange 1 through 139, CI Reactive Red 1 through 279, CI Reactive Violet 1 through 47, CI Reactive Blue 1 through 273, CI Reactive Green 1 through 33, CI Reactive Brown 1 through 50, CI Reactive Black 1 through 50; and a polymer selected from the group consisting of polysaccharides, proteins, polyalkyleneimines, polyamides, polyols, silicones; and (2) dye clay conjugates comprising at least one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11; and a smectite clay such as Montmorillonite clay, Hectorite clay, Saponite clay and mixtures thereof.

Other preferred dye conjugates include those selected from the group consisting of (1) dye polymer conjugates comprising (i) at least one reactive dye selected from the group consisting of reactive dyes C.I. Reactive Violet 1, 2, 4, 5, 22, 46; C.I. Reactive Blue 2, 4, 5-8, 10, 13, 15, 19, 21, 27, 28, 36, 40, 49, 50, 69, 74, 81, 94, 109; C.I. Reactive Red 1-4, 6-9, 12, 13, 17, 22, 24, 33, 35, 41, 43, 45, 58, 66, 83, 84, 88, 92, 96, 120, 125; C.I. Reactive Green 1, 8, 19; C.I. Reactive Black 5, 39 and 45, and (ii) a polymer selected from the group consisting of polysaccharides, proteins, polyalkyleneimines, polyamides, polyols, silicones; and (2) dye clay conjugates comprising (i) at least one cationic/basic dye selected from the group consisting of C.I. Basic Red 1, 2, 5, 9, 12, 13, 14, 15, 18, 22, 24, 27, 29, 30, 39, 45, 46, 76; C.I. Basic Violet 1, 2, 3, 4, 6, 7, 10, 11, 14, 16, 18, 21; C.I. Basic Blue 1, 3, 5, 7, 9, 11, 12, 14, 20, 22, 24, 41, 45, 47, 54, 55, 56, 57, 65, 67, 99, 162; and Basic Green 1 and 4; C.I. Basic Black 1, 2 and 7; and (ii) a smectite clay selected such as Montmorillonite clay, Hectorite clay, Saponite clay and mixtures thereof. Particularly preferred is a dye conjugate comprising modified carboxymethylcellulose having a remazol brilliant blue dye grafted thereon.

Preferably the dye conjugate may be selected from the group consisting of: (1) dye polymer conjugates comprising (i) at least one dye selected from the group consisting of C.I. Reactive Blue 19, C.I. Reactive Blue 8, C.I. Reactive Blue 10, C.I. Reactive Blue 21, C.I. Reactive Blue 28, C.I. Reactive Violet 22, C.I. Reactive Green 1, C.I. Reactive Red 1, C.I. Reactive Black 5, and (ii) a polymer selected from the group consisting of cellulose ethers such as carboxymethylcellulose including salts thereof such as sodium salt, methyl cellulose, hydroxyalkylcelluloses such as hydroxylethyl cellulose, and mixed ethers such as methyl hydroxyethylcellulose, methyl hydroxypropylcellulose, methyl carboxymethyl cellulose; fatty ester modified celluloses; phosphorylated celluloses such as those disclosed in WO 99/09124; cellulose, cationic starch, guar gum, uncharged starch; and (2) dye clay conjugates comprising (i) at least one dye selected from the group consisting of C.I. Basic Red 1, 14, 18; C.I. Basic Violet 1, 3, 10, 16; C.I. Basic Blue 1, 3, 7, 9, 22; C.I. Basic Green 1 and 4; and C.I. Basic Black 2, and (ii) a smectite clay such as Montmorillonite clay, Hectorite clay, Saponite clay and mixtures thereof.

Preferably the dye conjugate may be selected from the group consisting of C.I. Reactive Blue 19 carboxymethyl cellulose conjugate, C.I. Reactive Blue 19 cellulose conjugate, C.I. Reactive Blue 19 cationic starch conjugate, C.I. Reactive Blue 8 carboxymethyl cellulose conjugate, C.I. Reactive Blue 10 carboxymethyl cellulose conjugate, C.I. Reactive Blue 21 carboxymethyl cellulose conjugate, C.I. Reactive Blue 28 carboxymethyl cellulose conjugate, C.I Reactive Blue 19 guar gum conjugate, C.I. Reactive Violet 22 carboxymethyl cellulose conjugate, C.I. Reactive Violet 22 uncharged starch conjugate, C.I Reactive Violet 22 cationic starch conjugate, C.I. Reactive Violet 22 guar gum conjugate, C.I Reactive Violet 22 hydroxylethyl cellulose conjugate, C.I. Reactive Green 1 carboxymethyl cellulose conjugate, C.I. Reactive Red 1 carboxymethyl cellulose conjugate, C.I. Reactive Red 1 uncharged starch, C.I. Reactive Black 5 carboxymethyl cellulose conjugate and mixtures thereof; and said dye clay conjugate may be selected from the group consisting of Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Preferably, when a conjugate's polymer component comprises a cellulose ether, such as carboxymethyl cellulose, such cellulose ether may have one or more of the following properties: a weight average molecular weight preferably of less than 1,000,000 Daltons, more preferably from about 20,000 Daltons to about 500,000 Daltons, more preferably from about 20,000 Daltons to about 180,000 Daltons or even more preferably from about 30,000 Daltons to about 120,000 Daltons; preferably a degree of ether substitution, for example, carboxymethylation of from about 0.3 to about 1.2 or even more preferably from about 0.4 to about 0.8, said substitution preferably being blocky or random; and preferably a dye substitution ratio of from about 1:10 to about 1:50 or even more preferably from about 1:20 to about 1:30. The aforementioned cellulose ether, such as carboxymethyl cellulose, may be degraded by a method selected from the group consisting physical degradation, chemical degradation, enzymatic degradation and mixtures thereof. Suitable methods of chemical degradation include oxidative degradation, for example via hydrogen peroxide treatment. Suitable methods of enzymatic degradation include treatment with an enzyme such as cellulase. If the cellulose ether is degraded, preferably such degradation may occur after ether substitution but prior to dye substitution. Weight average molecular weight is determined according to the general procedure detailed in the Journal of Chromatography 1980, 192, pages 275-293 or Polymer Degradation and Stability 56 (1997) 331-337; degree of ether substitution, and degree of carboxymethylation which is a subset of degree of ether substitution, is determined according to ASTM Method D 1439-03 and the dye substitution is determined by combustion analysis.

In a further embodiment of the present invention the liquid detergent may further comprise a stripping agent. The stripping agent is understood to mean composition which is employed to remove excess or unwanted dye conjugate, preventing dye build-up and reducing further the risk of spotting and discoloration. An additional benefit resides in the fact that it is believed that dirt and soil adhere to dye conjugate coatings, when present, rather than to the material so coated, thus when such a coating is stripped, dirt as well as residual dye is removed. Preferably the stripping agent may be present at a level of at least 0.0001% by weight of the composition, preferably from about 0.0001% to about 10% by weight of the composition, more preferably from about 0.0001% to about 2% by weight of the composition or even more preferably from about 0.001% to about 0.1% by weight of the composition. Preferably the stripping agent may be selected from the group consisting of enzymes, zwitterionic polymers, nonionic detersive surfactants, transition metal catalysts, peracid/organic catalysts, alternative singlet oxygen generators, and mixtures thereof. Suitable enzymes typically include any enzyme that is suitable for use in the subject cleaning and/or treatment composition. Preferable enzymes include proteases or carbohydrases typically that are suitable for use in neutral or alkaline solutions. Suitable enzymes may be of animal, vegetable or microbial origin and include chemically or genetically modified variants. Suitable proteases include serine proteases, such as EC 3.4.21 serine endoproteases, trypsin proteases and trypsin-like proteases. Additional examples of suitable proteases include alkaline proteases derived from Bacillus, e.g. subtilisin Novo, subtilisin Carlsberg, subtilisins 309, 147 and 168, including variants from these backbones. Commercial examples of suitable enzymes include Savinase®, Alcalase®, Esperase®, Everlase®, Kannase® and Purafect®, Purafect OX®, Purafect MA®, Properase®. Additional suitable enzymes include BLAP protease and its variants as well as the proteases described in EP 0 251446, WO 91/06637, WO 95/10591 and WO 99/20727. Suitable carbohydrases include enzymes that degrade O-glycosyl bonds in homo and heteropolysaccharides such as celluloses, starches, xylans, (galacto)mannans, pectins, alginates, (arabino)galactans, gums, etc. Examples of such enzymes include neutral or alkaline enzymes hydrolysing o-glycosyl compounds, i.e. EC 3.2.1. enzymes such as (alpha)amylases, (hemi)cellulases, pectate hydrolases, pectin lyases, mannanases, xylanases, arabinases, xylanases, xyloglucanases and Endo EC 3.2.1 enzymes. Commercial examples of suitable enzymes include Natalase®, Termamyl®, Duramyl®, BAN®, Fungamyl®, Stainzyme®, Purastar®, Purafect OXAM® Carezyme®, Celluzymeg, Endolase®, Mannaway®, Purabrite®, Pectawash® and Pectaway®.

Visibly Distinct Beads

Visibly distinct is understood to mean that the beads can be individually perceived by the naked eye when dispersed in the liquid matrix. Preferably, the beads of the present invention will have a mean diameter (or effective diameter which is the diameter of a sphere of the same mass as a non-spherical bead) of from about 0.2 mm to about 8 mm, preferably about 0.3 mm to about 5 mm, more preferably from about 0.5 mm to about 4 mm and even more preferably 1 mm to 2 mm. These ranges are preferred as they are visible and those most appropriate for manufacturing and suspension in the liquid matrix. Preferably, the liquid detergent composition comprises from about 0.01% to about 10% by weight thereof, preferably from about 0.05% to about 5% by weight thereof, more preferably from about 0.1% to about 2% by weight thereof, and even more preferably from about 0.2% to about 1% of by weight thereof of visibly distinct beads.

The beads used in the detergent compositions of the present invention must typically be strong enough and stable enough to withstand the rigours of being introduced into and processed within commercially prepared liquid detergent products. The beads typically must also be physically and chemically stable within the liquid detergent compositions for prolonged periods of storage and shipping. However, when the bead containing liquid detergent product is used to form dilute aqueous washing liquors during the process of conventional laundering operations, these same beads and their contents must typically be able to dissolve or disintegrate in a manner and to the extent that the beads or visible residues therefrom, are not deposited onto fabrics being laundered in such dilute aqueous washing liquors.

Beads which are in the form of a liquid core comprising an ionically charged polymeric material and a surrounding semi-permeable membrane have been found to be particularly preferred. This membrane is one which can be formed by the interaction of some of the ionically charged polymer in the core with another polymeric material of opposite charge. The liquid core of the beads useful herein, in addition to containing an ionically charged polymeric material and a hueing agent, may also comprise water, solvents and wide variety of other materials such as laundering adjuncts which may or may not be ionic in nature. When used in the aqueous liquid detergent matrices of the present invention, the semi-permeable membrane permits the transfer of water or solvent between the liquid bead core and the aqueous liquid detergent composition matrix, by osmosis, until equilibrium is substantially reached. This contributes to the physical stability of the beads within the detergent composition matrix. Without being bound by theory, it is believed that when the bead-containing detergent composition is combined with fresh water to form a wash liquor, for example during a laundering operation, the resulting gradient of ionic strength between the resulting wash liquor and the bead core draws water into the core. This, in turn, exerts a high pressure on the bead membrane which consequently disintegrates. This mechanism contributes to the disintegration of the beads in use and to the release into the wash liquor of bead core material, including the hueing agent.

Detergent composition beads of the type utilized in this invention can, in general, be prepared by forming droplets or particles containing the requisite ionically charged polymeric material, and by thereafter contacting such droplets or particles with a liquid curing bath containing the requisite ionic polymeric material of opposite charge. This contact of droplets/particles with the curing bath causes the interaction, e.g., reaction, of the two types of polymeric materials to occur, and this in turn forms the resulting semi-permeable membrane around each droplet or particle. Beads of this general type and prepared in this general way are frequently referred to as microcapsules. Microcapsules of this type and their preparation and use are disclosed in greater detail in WO01/01927 and WO02/055649. Especially preferred beads for use herein are the microcapsules described in detail, along with their preparation in WO 05/012475.

The ionically charged polymeric materials used to form both the core and the membrane of the beads herein may be either cationically or anionically charged. Such materials are also referred to as polyelectrolytes. The cationic and anionic polyelectrolytes must be capable of reacting with each other to form a complex which will function as the semi-permeable membrane of the beads. Such polyelectrolyte materials may be either naturally occurring polymers or synthetic polymers (for the purposes of the invention, the term polymer includes oligomers).

The core of the beads may comprise the anionic polyelectrolyte while the curing bath, i.e., curing solution, which reacts with this core to form the bead-encapsulating membrane, may contain the cationic polyelectrolyte. Alternatively, it may be the other way round, with the core comprising the cationic polyelectrolyte and the curing containing the anionic polyelectrolyte. Preferably, the anionic polyelectrolyte is in the core.

Suitable anionic natural polyelectrolytes may be selected from anionic gums. Suitable anionic gums include alginates, carrageenan, gelan gum, carboxylmethyl cellulose, xanthan gum and mixtures thereof. Suitable anionic synthetic polyelectrolytes may be selected from the group consisting of polyacrylates and polymethacrylates, poly vinyl sulphates, polystyrene sulphonates, polyphosphates and mixtures thereof. The preferred polyanion for use herein is alginate. Alginate is the general name given to alginic acid and its salts. Alginic acid is a linear polysaccharide consisting of (1, 4) linked b-D-mannuronate (M) and its C-5 epimer a-L-guluronate (G) residues arranged in a non-regular blockwise pattern along the linear chain. The chemical composition and sequence of the M and G blocks depend on the biological source, growth and seasonal conditions. There are three dimmer blocks in alginate MM, GG and MG. The number ratio of mannuronic to guluronic units is known as the M:G ratio. In preferred embodiments the polyanion is alginate having an M:G ratio of at least about 1:1, preferably at least about 1.1:1, more preferably at least about 1.3:1 and even more preferably at least about 1.5:1.

The most preferred alginate for use in the microcapsules of the invention is that having: i) an M:G ratio of at least about 1:1, preferably at least about 2:1, more preferably at least about 3:1 and even more preferably at least about 4:1; ii) a fraction of GG blocks of less than about 0.5, more preferably less than about 0.4 and even more preferably less than about 0.3; and iii) a molecular weight of less than about 500 KDa. Preferable examples of suitable alginates include Lamitex M45 (ex. FMC), and Manutex RM, Kelgin HV, Manucol LH, Manucol DM and Manucol DH all of them supplied by ISP. The most preferred are Manucol DM and Manucol DH. Preferred alginates with high levels of mannuronic acid include those derived from the algae *Ascophyllum nodosum* or the algae *Macroystis pyrifera*. EP 1 634 944 A1 discloses further suitable alginates.

Suitable cationic natural polyelectrolytes may be selected from the group consisting of chitosan, chitosan derivatives such as quaternized chitosan and aminoalkylated and quaternized celluloses and poly-L-lysine and mixtures thereof. Suitable synthetic cationic polyelectrolytes may be selected from the group consisting of poly-(N,N,N-trialkylammoniumalkyl)acrylates, poly-(N-alkylpyridinium) salts, polyethylenimines, aliphatic ionone, poly-(diallyldialkylammonium) salts and mixtures thereof, wherein the alkyl is preferably short chain with from 1 to about 4 carbon atoms, preferably methyl.

Preferred for use herein as the core material for the beads are solutions of sodium alginate. Droplets of such solutions are preferably contacted with a curing bath which comprises poly(diallyldimethylammonium)chloride, chitosan polymer (having a molecular weight of from about 10 to 1,000 kDa, preferably from about 50 to 500 kDa), chitosan oligomers having a molecular weight of from about 300 to about 9,000 Da, preferably from about 500 to about 5000 Da) or a mixture of these chitosan oligomers and polymers. These combination of core solution and curing bath are preferred for the short reaction time and for the low permeability of the resulting beads, especially preferred being combinations of sodium alginate with poly(diallyldimethylammonium)chloride. Generally the volume of the curing bath is at least about 10 times, preferably at least about 100 times and more preferably at least about 1,000 times larger than that of a bead-forming droplet. Therefore, the amount of polyelectrolyte in the curing bath is generally well in excess over that of the polyelectrolyte in bead core liquid. Thus the concentration of the polyelectrolyte in the curing bath is not very critical. Generally, the concentration of the polyelectrolyte in the curing bath can range from about 0.5% to about 5%, more preferably from about 0.8% to about 2%, by weight of the curing bath. Preferably the pH of the bath is that at which the polyelectrolyte in the curing bath will optimally dissolve. The residence time of the droplets is determined by the thickness of the membrane that is to be achieved. Generally the membrane-forming reaction in the curing bath will take place with the curing bath maintained under agitation conditions.

Preferably, the curing bath for the beads will comprise a mixture of chitosan polymer and chitosan oligomers, preferably in a weight ratio from about 5:1 to about 1:1, more preferably from about 3:1 to about 1:3. Such a composition provides a bead membrane of both good strength and low membrane permeability.

The bead membrane will preferably control the osmotic absorption behaviour of the bead. Generally such a membrane, is a complex which completely encapsulates the core and all of the materials therein. Although it can be difficult to determine where the membrane ends and the bead core begins, this membrane complex will generally have a thickness typical of osmotic membranes known in the art. At a minimum, such thickness can be molecular. Preferably, the membrane permeability is such that it allows the transfer of water or solvent across it. Preferably, however, the membrane will prevent the leaching of actives out of the beads or actives into the beads; for instance, the hueing agent or enzymes.

The core liquid used to form the beads may contain, in addition to the required polyelectrolyte and hueing agent, a variety of additional materials. Such additional materials may include density modifiers; anti-microbial agents, ionic strength modifiers; laundry adjuncts of the type essentially included in the laundry detergent compositions herein; detergent composition adjuncts optionally included in the detergent compositions herein; membrane permeability regulators; as well as solvents, dispersants and emulsifiers suitable for dissolving, emulsifying or dispersing all of the components of the bead core liquid into a homogenous fluid. The bead core liquid may also comprise high molecular weight (greater than about 12,000) hydrophilic materials such as enzymes. Such materials can be included in the bead core solution and will then eventually be held within and protected by the membrane-encapsulated beads. Such materials do not readily pass through the bead membrane and will thus be held within the bead core until the beads disintegrate within the aqueous washing liquor. It will also be appreciated that equally the bead membrane may protect the contents of the bead core from such materials when they are present in the liquid matrix and are not compatible with the contents of the core. An example of when this might be the case is when the liquid matrix comprises a stripping agent, such as a stripping enzyme.

The bead core liquid is added to the curing solution or bath to form the visibly distinct beads by passing the bead core liquid through one or more nozzles or orifices to form a coherent, preferably laminar-flowing, fluid stream. Preferably the fluid stream is then "cut" into separate droplets/particles by mechanically passing a shearing force through the stream at intervals, preferably regular intervals, along the length of the fluid stream. That shearing force can be provided by a mechanical element such as a knife or rotating wire or can be provided by the shearing action of a cutting fluid such as water or an air jet. The fluid, preferably laminar-flowing, stream into which the bead core is formed can result from simple gravity flow of such a liquid through one or more orifices. More preferably, however, the bead core liquid will be forced through one or more orifices. Most preferably, the bead core liquid will be forced through one or more orifices or nozzles by applying pressure to the bulk fluid on one side of the orifices or nozzles. Such pressure application can thus be used to form "jets" of laminar-flowing fluid streams which can be more readily "cut" into droplets or particles of controlled and relatively regular size and configuration. Such fluids streams can, of course, be of any geometric configuration depending on the shape and size of the nozzles or orifice which the fluid flows through and further depending on the extruding pressure used and the rheology of the core liquid.

Most conventionally, the fluid jet stream(s) will be generally cylindrical and the cutting of such fluid jet streams will form, immediately after cutting, droplets or particles in the form of cylindrical segments. As these segments fall toward the curing bath into which they are to be dropped, they generally form themselves into substantially spherical droplets due to surface tension effects.

Devices suitable for forming and cutting fluid jets are known in the art and are suitable forming the beads used in the detergent compositions herein. One such device is available from GeniaLab and is sold under the trade name Jet Cutter™. Methods and devices for forming beads using jet-cutter technology are described in greater detail in DE 44 34 998 and in PCT patent publication No. WO 00/48722.

In preferred embodiments using the Jet Cutter™ device, the fluid jet stream of the first solution is form by passing the solution through a nozzle having a diameter of from about 0.2 mm to about 8 mm, more preferably from about 0.5 mm to about 4 mm, using a through-put rate of from about 0.5 g/s to about 20 g/s, more preferably about 1 g/s to about 6 g/s. The fluid jet stream is preferably cut by mechanical means, especially preferred being rotating cutting wires having a diameter of from about 10 μm to about 1000 μm, more preferably from about 50 μm to about 500 μm, and having a cutting speed of from about 500 rpm to about 10000 rpm, more preferably from about 1000 rpm to about 6000 rpm. The bead forming process is preferably carried out at ambient temperature, although higher temperatures may be used if non-heat sensitive materials are to be encapsulated in order to speed up the complexation reaction. Once the beads are formed they are removed from the reaction bath, preferably cleaned, before optionally being stored in a storage or transportation solution, and then finally they may be added to the liquid matrix. Preferably, they are added under agitation so as to ensure their even distribution throughout the liquid matrix.

Liquid Matrix

The liquid detergent is preferably an aqueous liquid matrix. Preferably the liquid detergent will comprise washing adjuncts selected from the group consisting of surfactants, builders, enzymes, optical brighteners, dye transfer inhibition agents, sud suppressors, detersive soil release polymers, other fabric care benefit agents, and combinations of these washing adjunct types. All of these materials are of the type conventionally used in liquid detergents. The essential and optional components of the liquid detergent composition are described in greater detail as follows.

Preferably the liquid detergent compositions herein will essentially comprises from about 5% to about 50% by weight, preferably from about 8% to about 40% by weight, more preferably from about 10% to about 35% by weight of a certain kind of detersive surfactant component. Such an essential detersive surfactant component may comprise anionic surfactants, non-ionic surfactants, cationic surfactants, ampholytic surfactants, zwitterionic surfactants, semi-polar non-ionic surfactants or combinations thereof.

The liquid detergents of the present invention may comprise one or more detergent builders or builder systems. When a builder is used, the subject composition will typically comprise at least about 1%, preferably from about 5% to about 60% or even from about 10% to about 40% builder by weight of the subject composition. Examples of suitable builders include alkali metal, ammonium and alkanolammonium salts of polyphosphates, alkali metal silicates, alkaline earth and alkali metal carbonates, aluminosilicate builders, zeolites, polycarboxylate compounds, ether hydroxypolycarboxylates, copolymers of maleic anhydride with ethylene or vinyl methyl ether, 1,3,5-trihydroxy benzene-2,4,6-trisulphonic acid and carboxymethyloxysuccinic acid, the various alkali metal, ammonium and substituted ammonium salts of citric acid, fatty acid soaps, the various alkali metal, ammonium and substituted ammonium salts the of the fatty acid soaps, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid and soluble salts thereof. Other examples are DEQUEST® sold by Monsanto and those sold by BASF under the SOKALAN® trademark, copolymers of polyacrylic acid with either ionic and/or hydrophobic materials.

The liquid detergents compositions can comprise one or more enzymes which provide cleaning performance and/or fabric care benefits. A typical combination is an enzyme cocktail that may comprise a protease, lipase, cutinase and/or cellulase in conjunction with amylase. Detersive enzymes are discussed in greater detail in U.S. Pat. No. 6,579,839. If employed, enzymes will normally be incorporated into the liquid laundry detergent compositions herein at levels sufficient to provide up to 10 mg; more typically from about 0.01 mg to about 5 mg, of active enzyme per gram of the composition. In other words, the liquid detergent composition can preferably comprise from about 0.001% to about 5%, preferably from about 0.01% to about 1% by weight, of a commercial enzyme preparation. Protease enzymes, for example, are usually present in such commercial preparations at levels sufficient to provide from about 0.005 to about 0.1 Anson units (AU) of activity per gram of detergent composition.

The liquid detergent composition may also comprise one or more optical brighteners, also known as fluorescent whitening agents (FWAs), which are deposited onto fabrics or laundered garments whereupon they fluoresce. Preferred optical brighteners are anionic in character. Many are stilbene derivatives. Examples of such materials include disodium 4,4'-bis-(2-diethanolamino-4-anilino-s-triazin-6-ylamino)stilbene-2:2' disulphonate, disodium 4, -4'-bis-(2-morpholino-4-anilino-s-triazin-6-ylamino)stilbene-2:2' disulphonate, disodium 4,4'-bis-(2,4-dianilino-s-triazn-6-ylamino)stilbene-2:2'-disulphonate, monosodium 4',4"-bis-(2,4-dianilino-s-triazin-6-ylamino)stilbene-2-sulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2' disulphonate, disodium 4,4'-bis-(2-anilino-4-(1methyl-2-hydroxyethylamino)-s-triazin-6-ylamino)stilbene-2,2'disulphonate, sodium 2(stilbyl-4"-(naohtho-1',2':4,5)-1,2,3-triazole-2"-sulphonate and 4,4'-bis(2-sulphostyryl)biphenyl. Brighteners have been marketed under the trade names Tinopal™ and Brightener No. (#)™ by Ciba-Geigy. They are described in greater detail in European Patent Application EP-A-753-567 and U.S. Pat. No. 5,174,927. If employed, optical brighteners will typically be incorporated into the liquid laundry detergent compositions herein in concentrations ranging from about 0.01% to about 1%, preferably from about 0.05% to about 0.5% by weight.

The laundry washing adjunct component of the compositions herein may comprise one or more dye transfer inhibition agents which permit desirable laundering of coloured fabrics. Suitable polymeric dye transfer inhibiting agents include but are not limited to polyvinylpyrrolidone polymers, polyamine N-oxide polymers, copolymers or N-vinylpyrrolidone and N-vinylimidazole, polyvinyloxazolidones, and polyvinylimidazoles or mixtures thereof. Suitable dye transfer inhibition agents are described in greater detail in U.S. Pat. Nos. 5,783,548; 5,604,194; and 5,466,802. If employed, dye transfer inhibiting agents will typically be incorporated into the liquid laundry detergent compositions herein in concentrations ranging from about 0.0001%, more preferably from about 0.01%, most preferably from about 0.03% by weight to about 10%, more preferably to about 2%, most preferably to about 1% by weight.

The laundry washing adjunct component of the compositions herein may comprise one or more materials which act as sud suppressors to minimize over-sudding of the compositions herein when they are employed for laundering of fabrics in automatic washing machines. Frequently, sud suppressor systems are based on starches, silicones or silica-silicone combinations. Examples of suitable sud suppressors for use herein are disclosed in U.S. Pat. Nos. 5,707,950 and 5,728,671. A preferred sud suppressor is a polydimethylsiloxane compounded with silica. If employed, suds suppressors will typically be incorporated into the liquid laundry detergent compositions herein in concentrations ranging from about 0.001% to about 2% by weight. More preferably, sud suppressors can comprise from about 0.01% to about 1% by weight of the compositions herein.

The laundry washing adjunct component of the compositions herein may comprise one or more detersive soil release polymers which provide fabric treatment benefits. Polymeric soil release agents useful in the present invention include copolymeric blocks of terephthalate and polyethylene oxide, and the like. A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate to polyethylene oxide terephthalate units of from about 25:75 to about 35:65. This polyethylene terephthalate contains polyethylene oxide blocks having molecular weights of from about 300 to about 2000. The molecular weight of the polymeric soil release agent is in the range of from about 5,000 to about 55,000. Suitable soil release polymers are descried in greater detail in U.S. Pat. Nos. 5,574,179; 4,956,447; 4,861,512; and 4,702,857. If employed, soil release polymers will typically be incorporated into the liquid laundry detergent compositions herein in concentrations ranging from about 0.01% to about 10%, more preferably from about 0.1% to about 5%, by weight of the composition.

The liquid detergent compositions of the present invention can also contain dispersants. Suitable water-soluble organic materials include the homo- or co-polymeric acids or their salts, in which the polycarboxylic acid comprises at least two carboxyl radicals separated from each other by not more than two carbon atom. Preferably, a combination of conjugated and unconjugated polymers may be especially useful as the two components can be balanced to provide preferred levels of deposition of the polymer-dye conjugate and in order to provide whiteness maintenance through reduced soil deposition. Thus in one aspect of the invention, compositions of the present invention may comprise a dispersant polymer selected from the group consisting of cellulose ethers such as carboxymethylcellulose including salts thereof such as sodium salt, methyl cellulose, hydroxyalkylcelluloses such as hydroxylethyl cellulose, and mixed ethers such as methyl hydroxyethylcellulose, methyl hydroxypropylcellulose, methyl carboxymethyl cellulose; phosphorylated celluloses such as those disclosed in WO 99/09124; cellulose, cationic starch, guar gum, uncharged starch, and mixtures thereof. Such dispersant polymer may be wholly or partially provided as a separate ingredient or may be wholly or partially provided in the form of unconjugated polymer in the dye conjugate reaction mixture. Amounts of dispersant polymer based on total cleaning composition weight may include from about 0.05% to about 10%, from about 0.1 to about 5% or even from about 0.1% to about 2%.

The liquid detergent compositions herein may contain a chelating agent. Suitable chelating agents include copper, iron and/or manganese chelating agents and mixtures thereof. When a chelating agent is used, the subject composition may comprise from about 0.1% to about 15% or even from about 3.0% to about 10% chelating agent by weight of the subject composition. Examples of suitable chelating agents and levels of use are described in U.S. Pat. Nos. 3,812,044; 4,704,233; 5,292,446; 5,445,747; 5,531,915; 5,545,352; 5,576,282; 5,641,739; 5,703,031; 5,705,464; 5,710,115; 5,710,115; 5,712,242; 5,721,205; 5,728,671; 5,747,440; 5,780,419; 5,879,409; 5,929,010; 5,929,018; 5,958,866; 5,965,514; 5,972,038; 6,172,021; and 6,503,876.

In addition to the optical brighteners and soil release polymers hereinbefore described, the laundry washing adjunct component of the compositions herein may also comprise additional fabric care or benefit agents which can be deposited onto fabric being laundered and which thereupon provide one or more types of fabric care or treatment benefits. Such benefits can include, for example, anti-static effects, ease-of-ironing effects, anti-abrasion benefits, anti-pilling effects, colour protection, wrinkle removal or improved resistance to wrinkling, fabric substantive perfume or odour benefits, malodour protection benefits and the like. A wide variety of materials which are suitable for providing such benefits and which can be deposited onto fabrics being laundered are known in the art. Such materials can include, for example, clays; starches; polyamines; un-functionalised and functionalised silicones such as aminosilicones and quaternary nitrogen-containing cationic silicones; cellulosic polymers, and the like. Materials of these types are described in greater detail in one or more of the following publications: U.S. Pat. Nos. 6,525,013; 5,178,254; WO 02/18528; WO 00/71897; WO 00/71806; WO 98/39401; and WO 98/29528. If employed, such additional fabric care benefit agents polymers can typically be incorporated into the liquid laundry detergent compositions herein in concentrations ranging from about 0.05% to about 20% by weight, depending on the nature of the materials to be deposited and the benefit(s) they are to provide. More preferably, such fabric care benefit agents can comprise from about 0.1% to about 10% by weight of the composition.

EXAMPLES

Example 1

Liquid Detergent Comprising Beads which Contain a Hueing Agent

An aqueous mixture comprising 5.3% by weight thereof sodium alginate from brown algae (Manucol DH—Kelco International), 0.8% by weight thereof polyvinylalcohol (PVA) (Mowiol 3-83—Clariant), 0.1% by weight thereof. $TiO_2$ (Aldrich), 0.3% by weight thereof acticide MBS, 1% by weight thereof. Acusol OP301 (Rohm&Haas), 0.4% by weight thereof. Magic Blue (Megazyme—a modified carboxymethylcellulose (CMC) backbone with at least one reactive blue dye (Remasol Brilliant blue) covalently grafted thereon) and the balance deionised water was prepared. First the PVA was dissolved in the water at 60° C. After cooling down to room temperature, the $TiO_2$, Acusol OP301, acticide MBS and alginate were all added under agitation and then finally the Magic Blue. The above solution was extruded at a throughput of 4.87 g/s through a 1.0 mm nozzle and cut using a rotational cutting tool containing 24 wires of 200 micron thickness (JetCutter™ from GeniaLab) with a cutting speed of 3150 rpm to form spherical droplets with a diameter between 1000 and 1500 microns. The droplets are allowed to fall into an agitated hardening bath that contained 10 litres of a 1% chitosan solution (Chitoclear from Primex) brought to pH 2.5 (at a temperature of 25° C.) with HCl. After a hardening time of 15 minutes, the beads were separated from the chitosan solution via filtration, washed with plenty of deionised water and stored in a 0.9% NaCl solution.

1.b. Preparation of the Liquid Detergent Matrix:

The liquid detergent matrix is prepared by combining its components with water in a suitable vessel under suitable agitation. The resulting composition is shown in Table I.

TABLE I

| Liquid detergent matrix | |
|---|---|
| Component | Concentration (Wt %) |
| $C_{12}$LAS | 7.5 |
| $C_{14-15}EO_8$ Alcohol Ethoxylate | 5.5 |
| $C_{12-14}$ Amine Oxide | 1.0 |
| Citric Acid | 2.2 |
| $C_{12-18}$ Fatty Acid | 5.2 |
| Boric acid | 1.5 |

TABLE I-continued

| Liquid detergent matrix | |
|---|---|
| Component | Concentration (Wt %) |
| DETPMP[1] Chelant | 0.6 |
| Ethoxylated Polyamine Dispersants | 1.5 |
| Silicone/Silica Suds Suppressor | 0.02 |
| Ethanol | 1.4 |
| Propane Diol | 4.5 |
| Monoethanolamine | 0.5 |
| NaOH | up to pH 8.2 |
| Perfume, Brightener, Hydrotrope | 2.0 |
| Enzymes | 0.6 |
| Hydrogenated Castor Oil derivative | 0.2 |
| Other minors + water | Balance to 99% |

DETPMP[1]: diethylene triamine pentamethylene phosphonic acid 1.c. Preparation of the Liquid Detergent Composition:

After the beads are filtered off from the NaCl solution, they are stirred into the liquid detergent as described hereinabove at a concentration of 1% by weight of the liquid detergent composition. The beads remained suspended in the liquid detergent and the Magic Blue remained enclosed within the beads. The level of Magic Blue was therefore of about 0.004% by weight of the liquid detergent composition.

Example 2

Liquid Detergent Comprising a Hueing Agent Both in the Liquid Detergent Matrix and in the Beads 2.a. Preparation of Beads:

The beads were prepared in the same way as those in Example 1.

2.b. Preparation of the Liquid Detergent Matrix:

The liquid detergent matrix (containing the hueing agent) is prepared by combining its components with water in a suitable vessel under suitable agitation. The resulting composition is shown in Table II.

TABLE II

| liquid detergent matrix | |
|---|---|
| Component | Concentration (Wt %) |
| $C_{12}$LAS | 7.8 |
| $C_{14-15}EO_8$ Alcohol Ethoxylate | 5.5 |
| $C_{12-14}$ Amine Oxide | 0.9 |
| Citric Acid | 2.2 |
| $C_{12-18}$ Fatty Acid | 5.2 |
| Boric acid | 1.0 |
| DETPMP[1] Chelant | 0.6 |
| Ethoxylated Polyamine Dispersants | 1.5 |
| Silicone/Silica Suds Suppressor | 0.02 |
| Ethanol | 1.4 |
| Propane Diol | 5.0 |
| Monoethanolamine | 0.5 |
| NaOH | up to pH 8.2 |
| Perfume, Brightener, Hydrotrope | 2.0 |
| Enzymes | 0.6 |
| Hydrogenated Castor Oil derivative | 0.2 |
| Hueing agent (Magic Blue) | 0.004 |
| Other minors + water | Balance to 99.4% |

DETPMP[1]: diethylene triamine pentamethylene phosphonic acid 2.c. Preparation of the Liquid Detergent Composition:

After the beads were filtered off from the NaCl solution, they were stirred into the liquid detergent as described here above at a concentration of 0.6% by weight of the liquid detergent composition. The beads remained suspended in the liquid detergent and the Magic Blue remained enclosed within the beads. The total level of Magic Blue is therefore 0.01% by weight of the liquid detergent composition (the beads comprise 1% by weight of thereof. Magic Blue and are dosed at about 0.6% by weight of the liquid detergent matrix which results in ⅗ of the magic blue via the beads and the remaining ⅖ of Magic Blue is directly in the liquid detergent matrix).

Example 3

Liquid Detergent with 2 Visually Distinct Types of Beads Comprising a Hueing Agent Both in the Liquid Detergent Matrix and in One the Bead Types 3.a. Preparation of Beads The Type 1 beads were prepared in the same way as those in Example 1. The Type 2 beads are made in exactly the same way as type 1 beads, except for the fact that they contain no hueing agent (Magic blue). The type 2 beads are therefore white instead of blue.

3.b. Preparation of the Liquid Detergent Matrix:

The liquid detergent matrix (containing the hueing agent) is prepared by combining its components with water in a suitable vessel under suitable agitation. The resulting composition is shown in Table IV.

TABLE IV

| liquid detergent matrix | |
|---|---|
| Component | Concentration (Wt %) |
| $C_{12}$LAS | 7.7 |
| $C_{14-15}EO_8$ Alcohol Ethoxylate | 5.5 |
| $C_{12-14}$ Amine Oxide | 0.9 |
| Citric Acid | 2.1 |
| $C_{12-18}$ Fatty Acid | 5.2 |
| Boric acid | 1.0 |
| DETPMP[1] Chelant | 0.6 |
| Ethoxylated Polyamine Dispersants | 1.5 |
| Silicone/Silica Suds Suppressor | 0.02 |
| Ethanol | 1.5 |
| Propane Diol | 5.0 |
| Monoethanolamine | 0.5 |
| NaOH | up to pH 8.2 |
| Perfume, Brightener, Hydrotrope | 2.0 |
| Enzymes | 0.6 |
| Hydrogenated Castor Oil derivative | 0.2 |
| Hueing agent (Magic Blue) | 0.004 |
| Other minors + water | Balance to 99.0% |

DETPMP[1]: diethylene triamine pentamethylene phosphonic acid 3.c. Preparation of the Liquid Detergent Composition:

After the beads were filtered off from the NaCl solution, both bead types were stirred into the liquid detergent as described here above, both at a concentration of about 0.5% by weight of the liquid detergent composition. The beads remained suspended in the liquid detergent and the Magic Blue remained enclosed within the type 1 beads. The total level of Magic Blue is therefore about 0.009% by weight of the liquid detergent composition (of that 0.009%, about ⅕ of the Magic Blue comes from the type 1 beads, and about ⅘ is added directly into the liquid matrix).

What is claimed is:

1. A liquid detergent composition comprising a liquid matrix having dispersed therein a plurality of visibly distinct beads, wherein:

a. the liquid matrix comprises a stripping agent selected from the group consisting of enzymes, zwitterionic polymers, non-ionic detersive surfactants, transition metal catalysts, per-acid/organic catalysts, alternative singlet oxygen generators and mixtures thereof;

b. the visibly distinct beads have a diameter of from about 0.2 mm to about 8 mm, are in the form of polyelectrolyte complex microcapsules comprising alginate and chitosan, and the complex microcapsules comprise a hueing agent; and c. the hueing agent is a dye conjugate selected from the group consisting of dye-polymer conjugates, dye-clay conjugates, and combinations thereof.

2. A liquid detergent composition according to claim 1, wherein the liquid matrix also comprises a hueing agent.

3. A liquid detergent composition according to claim 2, wherein the liquid matrix further comprises from about 0.00001% to about 1%, by weight of the liquid detergent compositions, of a hueing agent.

4. A liquid detergent composition according to claim 2, wherein the ratio by weight of hueing agent in the complex microcapsules to that in the liquid matrix phase is from about 5:1 to about 1:5.

5. A liquid detergent composition according to claim 1, wherein the complex microcapsules comprise from about 0.00001% to about 1%, by weight of the liquid detergent composition, of a hueing agent.

6. A liquid detergent composition according to claim 1, wherein the dye conjugate comprises a modified carboxymethylcellulose having remazol brilliant blue dye grafted thereon.

7. A liquid detergent composition according to claim 1 comprising from about 0.01% to about 10% by weight of the composition of complex microcapsules.

8. A liquid detergent composition according to claim 1, wherein the liquid matrix is essentially free from colorants.

9. A liquid detergent composition according to claim 1, wherein the liquid matrix comprises a colorant, wherein the colorant has a different colour to the hueing agent.

10. A liquid detergent composition according to claim 1 wherein the liquid matrix further comprises a second set of a plurality of visibly distinct beads which are essentially free of hueing agent.

11. A liquid detergent composition according to claim 1 wherein the complex microcapsules further comprise a permeability regulator.

* * * * *